United States Patent [19]

Ford et al.

[11] 3,992,750

[45] Nov. 23, 1976

[54] HINGED SLIDE GATE

[75] Inventors: James A. Ford; David E. Bell, both of Sturgis, Mich.

[73] Assignee: Kirsch Company, Sturgis, Mich.

[22] Filed: Mar. 17, 1975

[21] Appl. No.: 558,836

[52] U.S. Cl. ..... 16/95 D

[51] Int. Cl.[2] ..... E05D 13/02

[58] Field of Search ..... 16/86.1, 86.2, 87.2, 16/87.4 R, 95 R, 95 D, 96 R, 96 D, 139, 146, 147; 160/345

[56] References Cited

UNITED STATES PATENTS

| | | | |
|---|---|---|---|
| 3,284,053 | 11/1966 | Weber | 160/345 X R |
| 3,337,903 | 8/1967 | Kenney | 16/87.4 R |
| 3,453,682 | 7/1969 | Salzmann | 16/87.4 R |
| 3,503,434 | 3/1970 | Ford | 16/87.4 R X |
| 3,587,131 | 6/1971 | Graf | 16/95 D |

*Primary Examiner*—Werner H. Schroeder
*Attorney, Agent, or Firm*—Woodhams, Blanchard and Flynn

[57] ABSTRACT

Combined pulley housing and end gate construction for a traverse rod. For application to a slotted traverse rod, there is provided a pulley housing receivable and fastenable within such traverse rod. Said pulley housing is arranged for the support of cord pulleys in any desired manner and arrangement. Said pulley housing also supports a gate which positions drapery supporting means at the end of the rod and closes the slot to prevent the escape of hangers positioned therewithin when the drapery is retracted. The gate is preferably mounted for pivoting on an axis substantially transverse to the slot and in one embodiment contains a pocket which fits over the end hanger for holding it in a predetermined position in said slot and with respect to the rod. The gate beyond such pocket lies closely adjacent, or in, said slot and includes snap means engageable with an edge of said slot for retaining the gate in this closed position and thereby closing said slot to prevent escape of hangers therefrom when the draperies are retracted. The gate may, however, be easily opened for removal of hangers from said slot or for insertion of additional hangers into said slot.

14 Claims, 12 Drawing Figures

HINGED SLIDE GATE

FIELD OF THE INVENTION

The invention relates to traverse rod construction and particularly to the construction of a pulley housing receivable into the end of a traverse rod, said pulley housing also supporting gate means which effects closing said slot against the escape of hangers therefrom and preferably also effects positioning of the drapery support means at a selected location near the end of said slot.

BACKGROUND OF THE INVENTION

In the development and improvement of traverse rods for the suspension of draperies and the opening and closing thereof, there has been a problem in anchoring the nonmoving end of the drapery at the appropriate end or ends of the traverse rod. Since it is often desired to provide access to the end of the traverse rod for introducing hangers thereinto and removing excess hangers therefrom, the approach in the past has often been to anchor the nonmoving end of the drapery in some manner to the pulley structure or other means located beyond the end of the traverse rod. However, this has often complicated the pulley structure and in some cases has resulted in such end of the drapery being hung from means having insufficient strength. On the other hand, to utilize the traverse rod itself for supporting the anchor hanger has often resulted in permanent fixing of such hanger to the end of the traverse rod with the requirement that a sufficient opening be provided ahead of such anchor hanger that hangers could be moved into and out from the traverse rod without disturbing the positioning of such anchor.

In the U.S. Pat. to Ford, No. 3,503,434, there is shown means for anchoring a hanger adjacent a bottom slotted traverse rod and this has been reasonably satisfactory in most instances. However, in order to insure sufficient strength for the support of the hanger and drapery suspended therefrom, the gate had to be made relatively stiff and since it moved on a very short radius it sometimes became difficult to manipulate.

Accordingly, in a continuing effort to improve traverse rods and components thereof, it is desirable to provide gate means generally applicable to either side or bottom slotted rods by which the slot thereof may be easily opened and closed for the introduction of hangers into said slot and/or the removal of same therefrom, together with, preferably, means associated therewith providing for the suspension of the fixed end of the drapery.

It is further desirable in connection particularly with side slotted rods, to provide means by which an anchor hanger can be supported in the traverse rod in the same manner as other hangers therein but wherein with simple means it can be held in an anchor position and the slot of the rod blocked against the escape of other hangers therefrom. It is further desirable, with side slotted rods, that such be accomplished by means which do not bear the weight of the hangers or the draperies suspended therefrom in order that the suspension of such anchor hanger on means which are stiff or difficult to manipulate may be avoided.

Accordingly, the objects of the invention include:

1. To provide an end structure for a slotted traverse rod for supporting cord pulleys and also supporting gate means by which the slot of said rod can be removably blocked against the escape of sliders therefrom.

2. To provide an end structure for a slotted traverse rod for supporting cord pulleys and also supporting gate means by which the slot of said rod can be removably blocked against the escape of sliders from therewithin and at the same time end anchor means may be held in a preselected end position.

3. To provide a device, as aforesaid, which is readily removable for the insertion and/or removal of hangers with respect to said slot.

4. To provide a device, as aforesaid, in which for at least a side slotted rod all hangers including the end anchor hanger are supported by the rod structure itself whereby special supporting structure for the anchor hanger can be avoided.

5. To provide a device, as aforesaid, in which for a side slotted rod the gate functions to prevent lengthwise movement of the anchor hanger from a single preselected position in the slot of the rod and which further functions to close the slot of the rod against escape of other hangers therefrom, whereby a relatively light construction of said gate will suffice for these purposes and weight supporting construction for same may be avoided.

6. To provide a device, as aforesaid, which is applicable for at least closure and opening of the slot to either a side slotted rod or to a bottom slotted rod.

7. To provide a device, as aforesaid, which can be provided with means for manual engagement to effect opening and closing thereof which is sufficiently spaced from the pivot point that a long lever arm will be available to move said gate easily against whatever friction may exist in the hinge.

8. To provide a device, as aforesaid, wherein the hinge is of relatively long extent so that it will hold the gate accurately with respect to the rod slot and will do so without said hinge itself being excessively tight.

9. To provide a device, as aforesaid, which can be used with minimal modification with a wide variety of specific drapery supporting means.

Other objects and purposes of the invention will be apparent to persons acquainted with a device of this sort upon reading the following specification and inspecting the accompanying drawings.

IN THE DRAWINGS

SUMMARY OF THE INVENTION

The invention contemplates pulley supporting structure for application to the end of a slotted traverse rod which structure also supports gate means for both closing the slot of such rod and for positioning fixed drapery supporting means at the end of the rod. The pulley retaining structure comprises frame means into which the pulleys are rotatably mounted and which projects into the traverse rod at the end thereof for reception and support therewithin. The gate means is hinged into said pulley supporting structure at a point outwardly of the end of the traverse rod and extends around the slotted wall of the traverse rod, whether at the side or the bottom thereof, to extend into or over said slot for closing same. A catch is preferably provided on at least one side of said gate for engaging a slot defining edge of the traverse rod for removably retaining said gate in closed position. The end of said gate facing the hangers in said slot is preferably sloped so that the force of hangers bearing against said gate will tend to urge same in a closing direction. Where the gate is used with a side slotted rod, the gate is further provided with an offset portion for partially surrounding an end hanger and holding same in a preselected position adjacent the end of the rod for supporting the fixed end of a drapery. When said gate is used with a bottom slotted rod, there is preferably provided an extension on the gate itself functioning as an anchor point to which the fixed end of a drapery can be hung. The gate in either use thus prevents the escape of hangers from said slot but said gate can be readily opened for insertion and/or removal of hangers from the slot.

DETAILED DESCRIPTION

Figure 1:
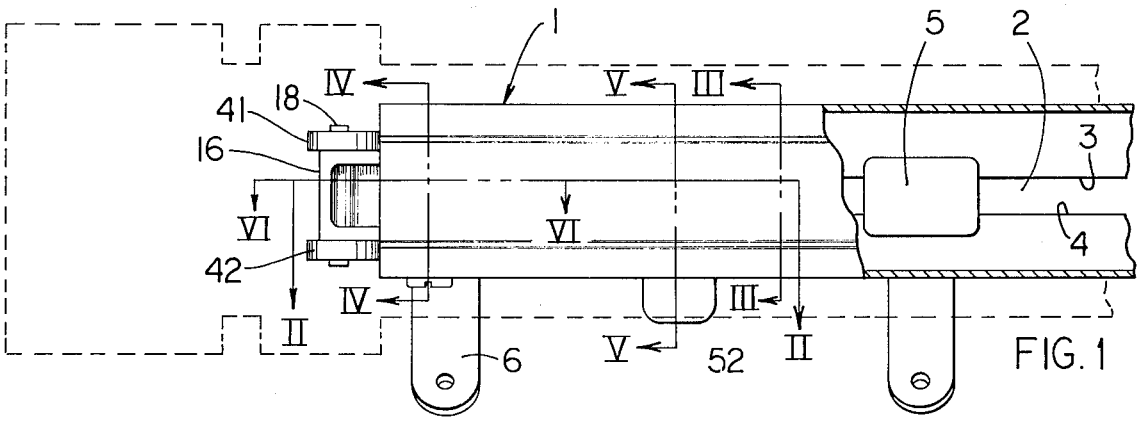
FIG. 1 is a front view, partially broken, showing the end of a traverse rod provided with a pulley housing and gate structure of the invention.

Turning now to the drawings in more detail, there is shown in FIG. 1 a partially broken front view of a traverse rod 1 having a side positioned rearwardly of the opening slot 2, said slot being defined by edges 3 and 4 of the traverse rod structure. A conventional slider 5 is positioned in the slot 2 for the support of draperies in a known manner. A further hanger 6 is positioned at the end of the slot 2 in the traverse rod for the support of the nonmoving end of the drapery supported by and from the traverse rod 1.

Figure 3:
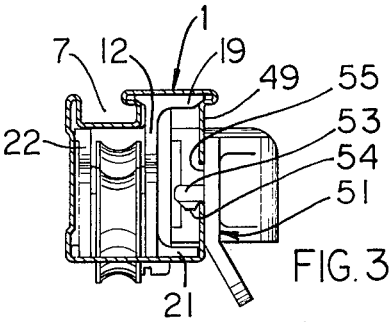
FIG. 3 is a section taken on the line III—III of FIG. 1.
Figure 4:
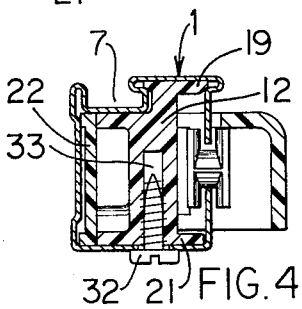
FIG. 4 is a section taken on the line IV—IV of FIG. 1.
Figure 5:
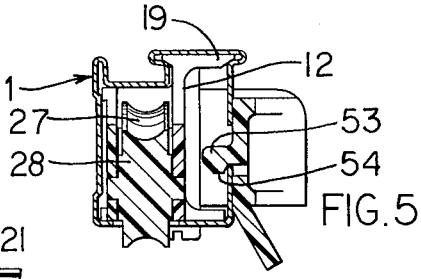
FIG. 5 is a section taken on the line V—V of FIG. 1.
Figure 6:
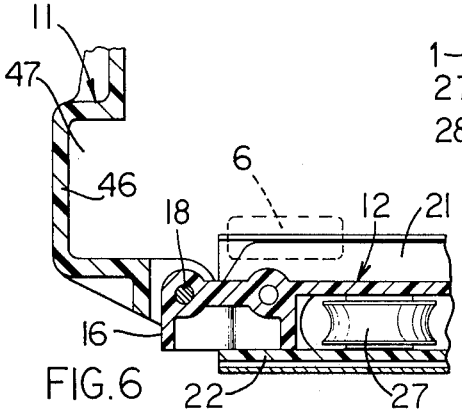
FIG. 6 is a section taken on the line VI—VI of FIG. 1.

The traverse rod itself may be any of many conventional shapes, such as the generally rectangular shape best shown in FIGS. 3 and 4 of the drawings, which rod in this instance is also provided with a mounting provided in its upper surface with a mounting groove 7. The end fitting 8 comprising the invention includes broadly a pulley supporting component 9 and a gate component 11 whose details will be developed further hereinafter.

Referring first to the pulley supporting component 9, same in this embodiment comprises a main support plate 12 having therein a pair of openings 13 and 14 for the reception of the stub axes of the hereinafter mentioned pulleys and a spacer structure 16 preferably integrally molded therewith for purposes appearing hereinafter. The upper surface of said spacer structure may also be provided with an opening 17 for reception thereinto of the hinge pin 18 for the gate structure 11 as hereinafter further detailed. In the presently illustrated embodiment, there is also provided a flange 19 comprising a T-head for the plate 12 by which same is caused to fit snugly into a correspondingly shaped portion of the traverse rod for firm reception and holding of same therewithin. It will be recognized, of course, that this portion of the structure will necessarily be modified as needed from one instance to another to enable the unit to fit a given traverse rod structure in any appropriate manner for holding the plate 12 vertically therewithin and in the instance as illustrated of use with a side slotted rod, spaced from the slotted side a distance sufficient to permit the passage of sliders between the plate 12 and the slotted side of the rod.

Figure 8:
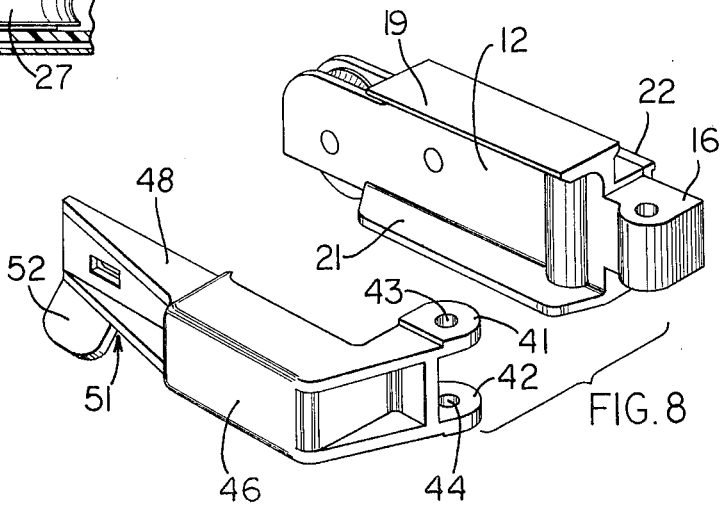
FIG. 8 is an oblique view from the opposite direction as that in FIG. 7 showing part of the components assembled and the gate unit in exploded relationship to the assembled portion.
Figure 7:
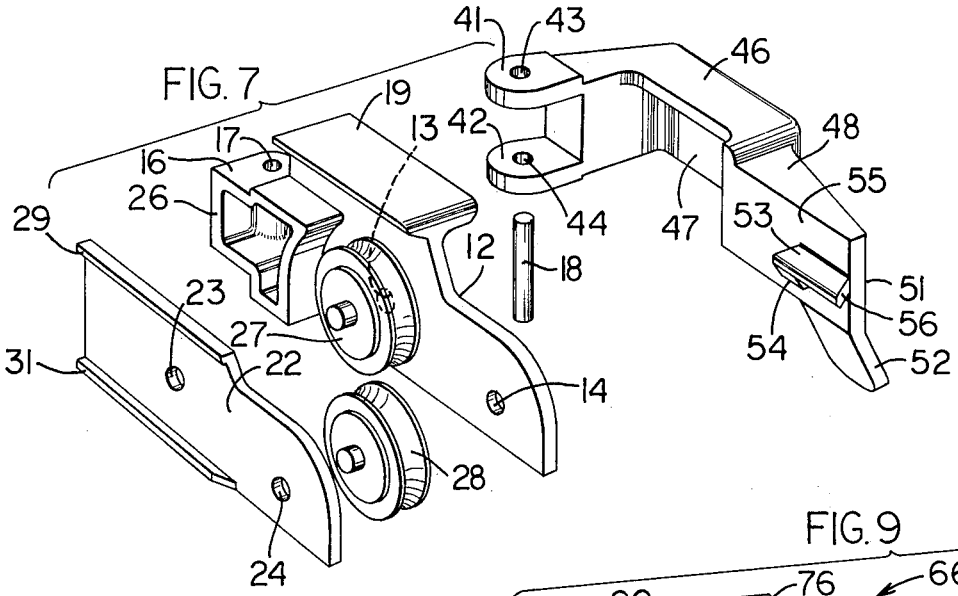
FIG. 7 is an exploded oblique view of the components comprising the illustrated embodiment of the invention.
Figure 9:
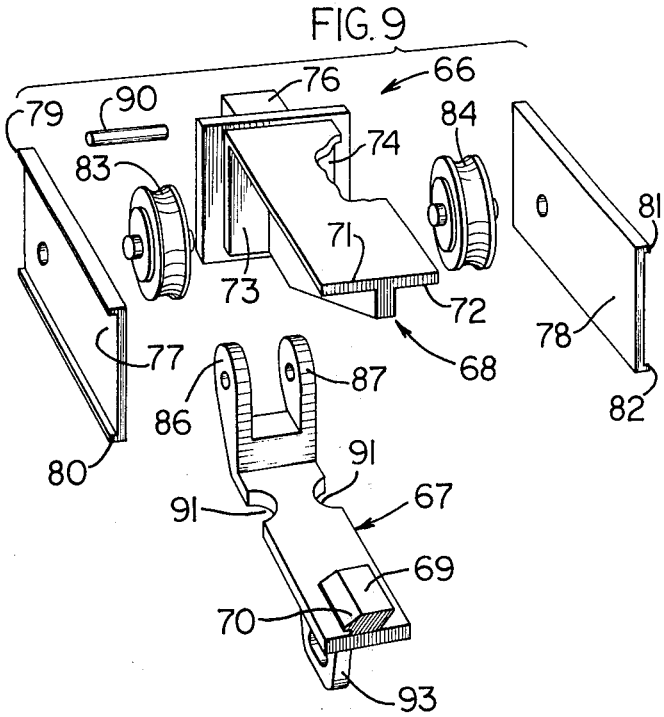
FIG. 9 is a vertical sectional illustration of a modification.
Figure 10:
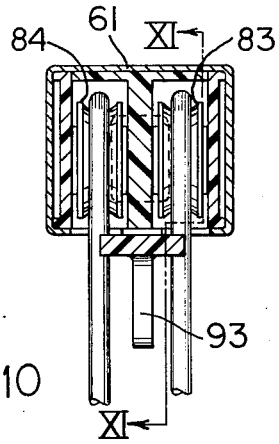
FIG. 10 is a partially exploded view similar to FIG. 8 showing the modification of FIG. 9.
Figure 11:
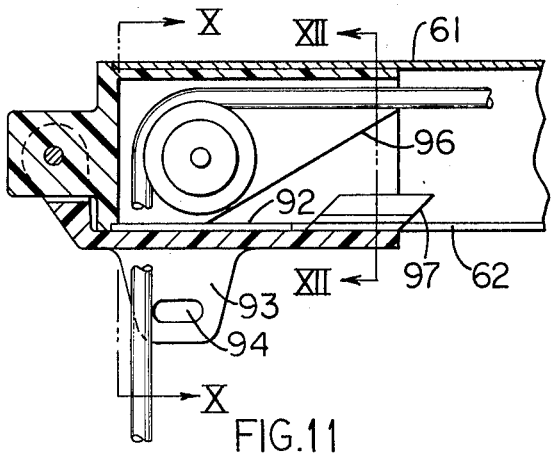
FIG. 11 is a longitudinal section taken on the line XI—XI of FIG. 10.
Figure 12:
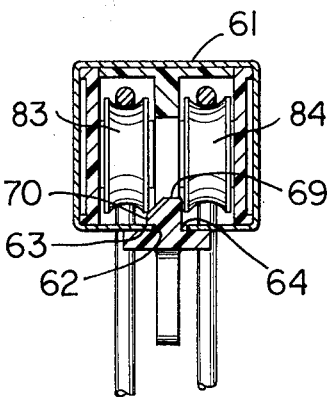
FIG. 12 is a section taken on the line XII—XII of FIG. 11.

There will also be provided at the bottom of said plate 12 a sidewardly extending flange 21 (FIGS. 4 and 8) which will serve to space appropriately the bottom of said plate 12 from the slotted side of the rod.

There is further provided a closure plate 22 having holes 23 and 24 therein in alignment with the holes 13 and 14 and provided for reception of the other stub shafts of the respective pulleys. Said plate 22 is positioned against the surface 26 of the spacer 16 with the pulleys 27 and 28 received between said plates 12 and 22 with their respective stub shafts received into the openings 13 and 14 for the one side and the openings 23 and 24 for the other side of each thereof. The plate 22 is fixed to the surface 26 in any convenient manner such as by an adhesive. Flanges 29 and 31 are provided if and as needed to effect appropriate spacing of the plate 22 from the adjacent side of the traverse rod. Thus, with the pulleys in position as shown and the plates 12 and 22 fixed rigidly together, the pulley component 9 provides a single package which may be slipped into the end of a traverse rod, will be firmly received herewithin and will hold the pulleys properly in operative position with respect thereto. If desired, and it will usually be desired, a screw 32 may be inserted through the bottom of the traverse rod into an opening 33 provided between the base plate 12 and the spacer 16 as best shown in FIG. 2 although other known means for opposing the pull of the cords may be employed if desired.

Turning now to the gate component 11, this includes appropriate hinge structure, here comprising a pair of hinge plates 41 and 42 arranged to embrace the spacer unit 16 on both top and bottom thereof with its openings 43 and 44 in alignment with the upper and lower ends of the opening 17 in said spacer unit 16. The hinge pin 18 is inserted into said openings for hinging the gate component 11 effectively thereto.

Figure 2:
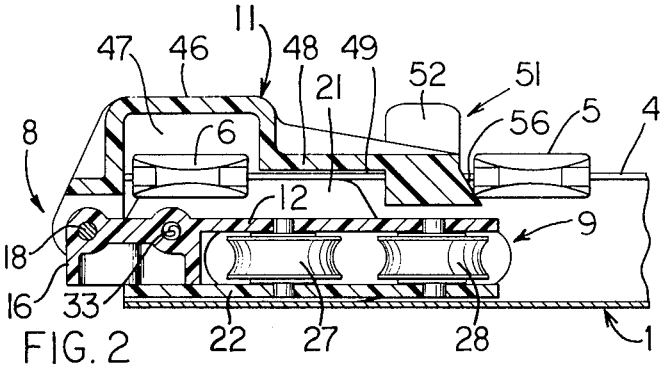
FIG. 2 is a section taken on the line II—II of FIG. 1.

Said gate component includes an offset portion 46 defining a recess 47 which extends generally around the end hanger 6 and is effective when the gate is closed as shown in FIG. 2 for holding said end hanger 6 against escape from the position shown in FIG. 2.

Said gate 11 has a further intermediate portion 48 which lies generally adjacent or against the outer surface of the back or slotted side 49 of the traverse rod and terminates in a manipulating head 51. Said manipulating head is preferably provided with a finger tab 52 for convenient control thereof and is further provided with a latch 53 for extending into the slot 2 of said traverse rod. Said latch 53 is provided with a downwardly extending lip spaced slightly inwardly from the surface 55 of the gate whereby (FIG. 3) to extend over the edge 4 defining the slot 2 for engaging same and holding the gate in proper closed position. The gate may be opened by merely lifting the free end thereof, as by use of the finger tab 52, sufficiently to enable the lip 54 to clear the edge 4. There may either be sufficient play in the hinge pin 18 or the plastic structure of the gate may be sufficiently flexible to permit such lifting.

Preferably the forward edge 56 of the latch 53 is sloped as shown in order that when the draperies are closed and the sliders are pushed toward the end of the traverse rod, the slider 5 will bear against said sloped edge 56 and hold the gate 11 in firmly closed position.

Thus, with a simple and easily executed movement of the gate 11, same may be opened for insertion or removal of hangers into or from the traverse rod with the gate then being easily closed for capturing a hanger in the position of the hanger 6 of FIG. 2 to support the nonmoving end of the traverse drape and for closing the slot 2 against the escape therefrom of the remaining hangers. The combined actions of the lip 54 and the sloped surface 56 will hold said gate firmly closed in all normal operation of the traverse rod but same can be readily opened manually without the necessity of tools when it is so desired. All of the components are readily moldable from plastic material and can be quickly applied to and fixed in position with respect to the traverse rod as a single unit merely by inserting the pulley component 9 into the traverse rod as above described and fixing the screw 32. Likewise, the parts can as readily be withdrawn from the traverse rod for repair or replacement merely by removing said screw and withdrawing the pulley and gate structure as a single unit therefrom.

MODIFICATION OF FIGS. 9 TO 12

Turning now to the modification shown in FIGS. 9 to 12 wherein the concept of the gate structure of the invention is applied to a bottom slotted rod, there is first shown a rod 61 of generally conventional structure having a bottom slot 62 defined by the edges of flanges 63 and 64 comprising the bottom walls of the rod. A pulley component 66 is here associated with the gate component 67 arranged for pivoting on a horizontal axis and functions to close the bottom slot 62 in a manner at least broadly similar to a closure of the side slot 2 in the embodiment of FIGS. 1–8. Here, however, said gate 67 merely closes the bottom slot and itself provides the hanger for the fixed end of the drapery and does not utilize a recess corresponding to the recess 47 for the capturing and retention of the standard hanger at the end of the rod.

In more detail, there is in this embodiment provided a central body 68 corresponding broadly to the central body 12 in the above-described embodiment and provided with spacer flanges 71–74 for purposes appearing following. A hinge projection 76 projects from said central body and is adapted for supporting the gate as hereinafter further detailed. End plates 77 and 78 are provided to bear against the free edges of the flanges 71–74 and themselves are provided with flanges 79, 80, 81 and 82 for effecting a snug fit of the pulley carrier within the traverse rod. Said body part 68 and end plates 77 and 78 are provided with openings for the reception of stub shafts on the respective pulleys 83 and 84 by which said pulleys are firmly held respectively between said central body and said end plates in generally the same manner as above described in more detail for the pulleys of the embodiment of FIGS. 1–8. The gate 67 is provided with pivot means, here flanges 86 and 87, for positioning on either side of the projection 76 and same are pivoted thereto by a suitable hinge pin 90. Said gate 67 extends along the underside of the traverse rod and is provided with a latch 69 having thereon a lip 70(FIG. 12) whereby to engage the edge of one of the flanges 63 and 64, here the edge of the flange 63, defining the slot 62, in order to hold the gate in the appropriate closed position.

Suitable portions 91 will be cut from both sides of the gate directly below the pulleys 83 and 84 to permit the pull cords of the traverse rod to extend therethrough and drop down on either side of the gate member 67. A depending flange 93 extends downwardly from the body of the gate member to provide through an opening 94 therein means for affixing a hook for the support of the nonmoving end of the drapery. Said flange also provides means for manually engaging the gate member for moving it laterally sufficiently to disengage the lip 70 of the latch 69 for releasing same to permit opening of the gate.

It will be recognized that upon opening of said gate, sliders may be freely introduced through the opening provided by cutout portions 92 of the flanges 63 and 64 beneath and under the cutback edge 96 of the central body 68.

As in the previous described embodiment, said latch structure 69 may also be provided with a slanted leading edge 97 to assist in holding same closed when sliders are pushed thereagainst by retraction of the draperies.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a means for closing the end of a slotted traverse rod, the combination comprising:

a body receivable into the end of a traverse rod and rigidly fixable with respect thereto and including one portion of a hinge member extending from said body to a point exteriorly of said traverse rod;

a gate member hingedly fixed to said hinge member and swingable about a hinge axis between a first position closely overlying the slot of said traverse rod and a second position rotationally spaced therefrom;

means for holding said gate member in said first position closely overlying the slot of the traverse rod and comprising a latch structure extending from the free end of said gate member remote from the hinged portion thereof through said slot and detachably embracing one edge of a flange defining said slot.

2. The device defined in claim 1 wherein said free end of said gate member includes an angularly positioned face extending angularly inward of said traverse rod when said gate member is in said second position and further extending angularly away from said hinge axis of said gate member and said body;

whereby said angularly positioned face provides an abutting surface limiting movement of sliders within said slot toward the otherwise open end of said traverse rod and effective upon urging of such a slider against said abutting surface to urge said gate member against said slotted surface of said traverse rod and toward its fully closed position.

3. A device for reception into a slotted traverse rod comprising in combination:

a first plate having flanges adaptable for fitting snugly to the interior of a traverse rod;

a second plate cooperating with said first plate to define therebetween a pulley zone opening to the interior of said traverse rod;

at least one pulley within said pulley zone and means on said plates supporting said pulleys in rotatable relationship therewith;

hinge supporting means projecting from one of said plates in a direction opposite to the open end of said pulley zone and carrying a first part of hinge means thereon;

a gate comprising first and second legs arranged at generally a right angle, the free end of the first leg carrying a second part of said hinge means and same being hingedly related to said first part and the free end of said second leg carrying latch means for detachble latching connection with an edge defining one side of a traverse rod slot;

the length of said first leg being so proportioned with respect to said traverse rod that when said first and second plates are assembled and inserted into the open end of a traverse rod, said second leg of said gate will, when aligned substantially parallel with said plates, lie snugly against the outer surface of the slotted wall of said traverse rod.

4. The device defined in claim 3 including also an offset portion in said second leg positioned between the connection thereto of said first leg and said latch means and defining a recess facing toward said first plate whereby when said first and second plates are assembled and inserted into the open end of a traverse rod and the second leg is positioned parallel to said plates, said recess will be adapted for embracing a hanger within said slot and holding same against longitudinal movement therein.

5. The device of claim 3 including a tab projecting from said second leg in a direction away from said plates and means on said tab for supporting a drapery in depending relationship therefrom.

6. The device of claim 1 wherein said body is containable within said traverse rod except for said one hinge member portion thereof, said gate member comprising first and second arms joined substantially at a right angle, the free end of said first arm being pivoted on said hinge axis and in the closed position of said gate member transversely covering at least the slotted part of the end of said traverse rod, said second arm being longer than the first arm and extending therefrom to cover the traverse rod slot in the closed position of said gate member.

7. The device of claim 6 in which said latch structure comprises a block-like member extending towards said slot from the free end portion of said second arm and having an undercut portion engageable with the traverse rod at the edge of said slot, the free end of said second arm having sufficient play laterally of said slot as to permit manual disengagement of said latch structure from said traverse rod by moving said second arm free end laterally of said slot prior to opening movement outwardly away therefrom.

8. The device of claim 1 including a recess in said gate member intermediate said latch structure and hinge axis and placeable in lateral opposition to said traverse rod slot, said recess being configured to loosely receive but not carry a drapery support slider carried by said traverse rod in said slot and thereby locate said slider adjacent the traverse rod end against unintended sliding movement along said traverse rod with said gate member in its closed position.

9. The device of claim 1 in which said gate member has an arm disposable beneath said body for closing a bottom opening slot in a traverse rod, said arm in the closed position of said gate member covering part of the length of said slot and sandwiching the slotted face of the traverse rod between said arm and said body, and including a tab pendent from said arm intermediate said hinge axis and latch structure for supporting the end portion of a drapery therefrom.

10. The device of claim 3 in which said second leg has a length exceeding two pulley diameters, said second leg extending substantially from a point opposed to said hinge means well beyond at least one said pulley, the substantial length of said second leg and spacing of said hinge means and latch means adjacent opposite ends thereof permitting both easy manual opening and reliable closure of said gate member.

11. The device of claim 5 in which said tab is locatable beneath a widened part of said slot which widened partis of sufficient width to release hangers from said traverse rod slot, such that downward hinging of said second leg away from said slot opens the widened part thereof for entry or exit of hangers from said slot, said latch means comprising a block-like member insertable through said slot and having a sloped face which upon endwise urging of a hanger thereagainst both blocks access of said hanger to said widened portion of said slot and tends to urge said gate more firmly closed.

12. A device for closing the end of a traverse rod of the kind having a longitudinal slot along which drapery support sliders are movable, and comprising:

a body fixable in the end of said traverse rod and having a hinge portion at its outer end defining a hinge axis substantially parallel to the plane of the slot of the traverse rod;

a gate member hinged on said body hinge portion and pivotable about said axis between a closed position closely overlying said slot and an open position angled from the plane of said slot;

abutment means on said gate member remote from said hinge axis and receivable through the traverse rod slot in said closed position, said abutment means having an abutment surface angled to face outward of said slot and away from said traverse rod end and responsive to endward urging of said slider thereagainst for biasing said gate member more firmly closed.

13. The device of claim 12 in which said abutment means further has a latch surface engageable with the slotted portion of said traverse rod for holding said gate member in its closed position.

14. The device of claim 12 in which said gate member has first and second arms at right angles, the first said arm being pivoted on said body at said hinge axis and pivotable endways of said traverse rod, said second arm being the portion of said gate member positionable to overlie the traverse rod slot and swingable away therefrom in the closed and open positions of said gate member, respectively, said second arm having a recess facing toward said slot and located between the first arm and the free end of said second arm, one side of said recess being substantially flush with said first arm and with the end of said traverse rod, said recess being sized to loosely receive a slider carried by said traverse rod in said slot and sized to limit sliding motion of said slider along said slot, said recess in the open position of said gate member providing increased spacing between said second arm and the end of said traverse rod opposite the slotted portion of said arm and providing sufficient room at the end of said traverse rod for loading and unloading of sliders from said traverse rod.

* * * * *